United States Patent [19]

Kincheloe

[11] Patent Number: 5,035,443

[45] Date of Patent: Jul. 30, 1991

[54] RELEASABLE SNOWBOARD BINDING

[76] Inventor: Chris V. Kincheloe, 3602 Hunts Point Rd., Bellevue, Wash. 98004

[21] Appl. No.: 500,298

[22] Filed: Mar. 27, 1990

[51] Int. Cl.[5] ..... A63C 9/00

[52] U.S. Cl. ..... 280/618; 280/14.2; 403/329

[58] Field of Search ..... 280/617, 618, 14.2, 280/607, 613; 403/325, 329

[56] References Cited

U.S. PATENT DOCUMENTS

| | | | |
|---|---|---|---|
| 2,706,119 | 4/1955 | Uphoff | 280/11.3 |
| 3,854,743 | 12/1974 | Hansen | 280/11.35 |
| 3,934,893 | 1/1976 | Greenleaf | 280/11.35 |
| 3,988,841 | 11/1976 | Salomon | 36/117 |
| 4,008,901 | 2/1977 | Conn | 280/7.13 |
| 4,162,089 | 7/1979 | Alber | 280/618 |
| 4,652,007 | 3/1987 | Dennis | 280/618 |
| 4,728,116 | 3/1988 | Hill | 280/618 |

FOREIGN PATENT DOCUMENTS

| | | | |
|---|---|---|---|
| 2604913 | 4/1988 | France | 280/14.2 |
| 2627993 | 9/1989 | France | 280/14.2 |
| 2628000 | 9/1989 | France | 280/14.2 |
| 2628981 | 9/1989 | France | 280/14.2 |
| WO10167 | 11/1989 | PCT Int'l Appl. | 280/14.2 |

OTHER PUBLICATIONS

Burton, Elite 140, Oct. 1988.

*Primary Examiner*—Andres Kashnikow
*Assistant Examiner*—Michael Mar
*Attorney, Agent, or Firm*—Glenn D. Bellamy

[57] ABSTRACT

A releasable foot binding for use in combination with a snowboard includes a socket component which is separably engageable with a foot-engaging component. The socket component is mounted on the snowboard and includes spaced-apart, upwardly-extending elongated side rails. Each side rail has an elongated flange portion extending laterally therefrom. The foot-engaging component is longitudinally engageable with the socket component and has a bottom which includes opposite side ribs positioned on the bottom to be slidably positionable below the flange portions of the socket component. A stop member limits movement of the foot-engaging component relative to the socket component beyond a fully-engaged position. A latch releasably secures the foot-engaging component against movement in the opposite longitudinal direction.

13 Claims, 3 Drawing Sheets

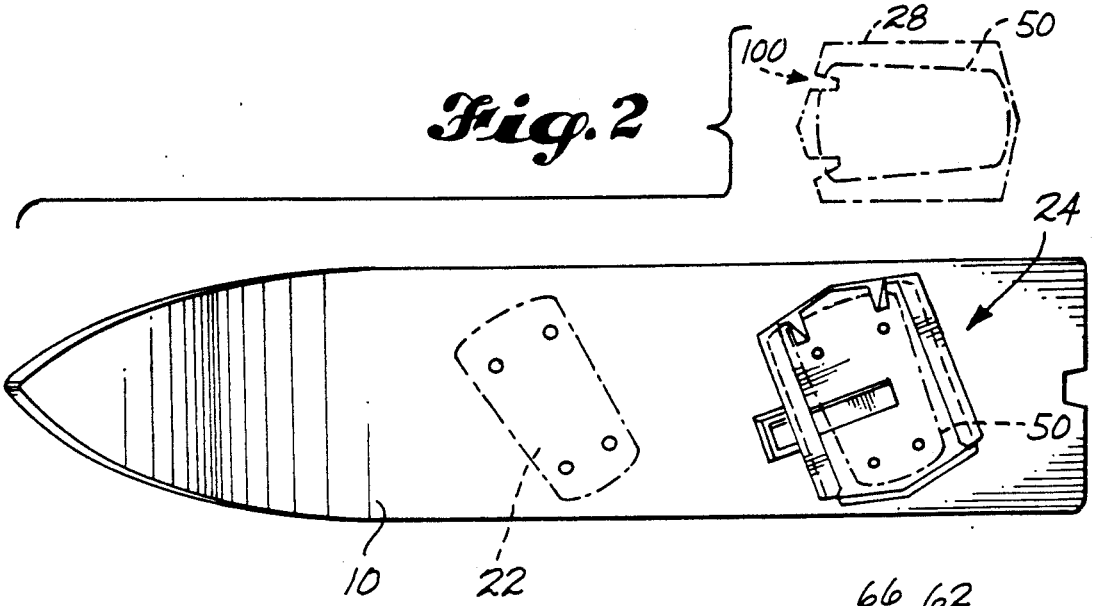
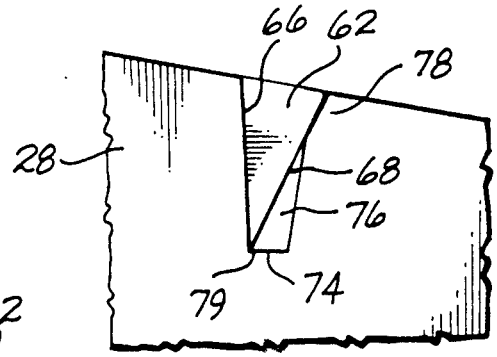
Fig. 9
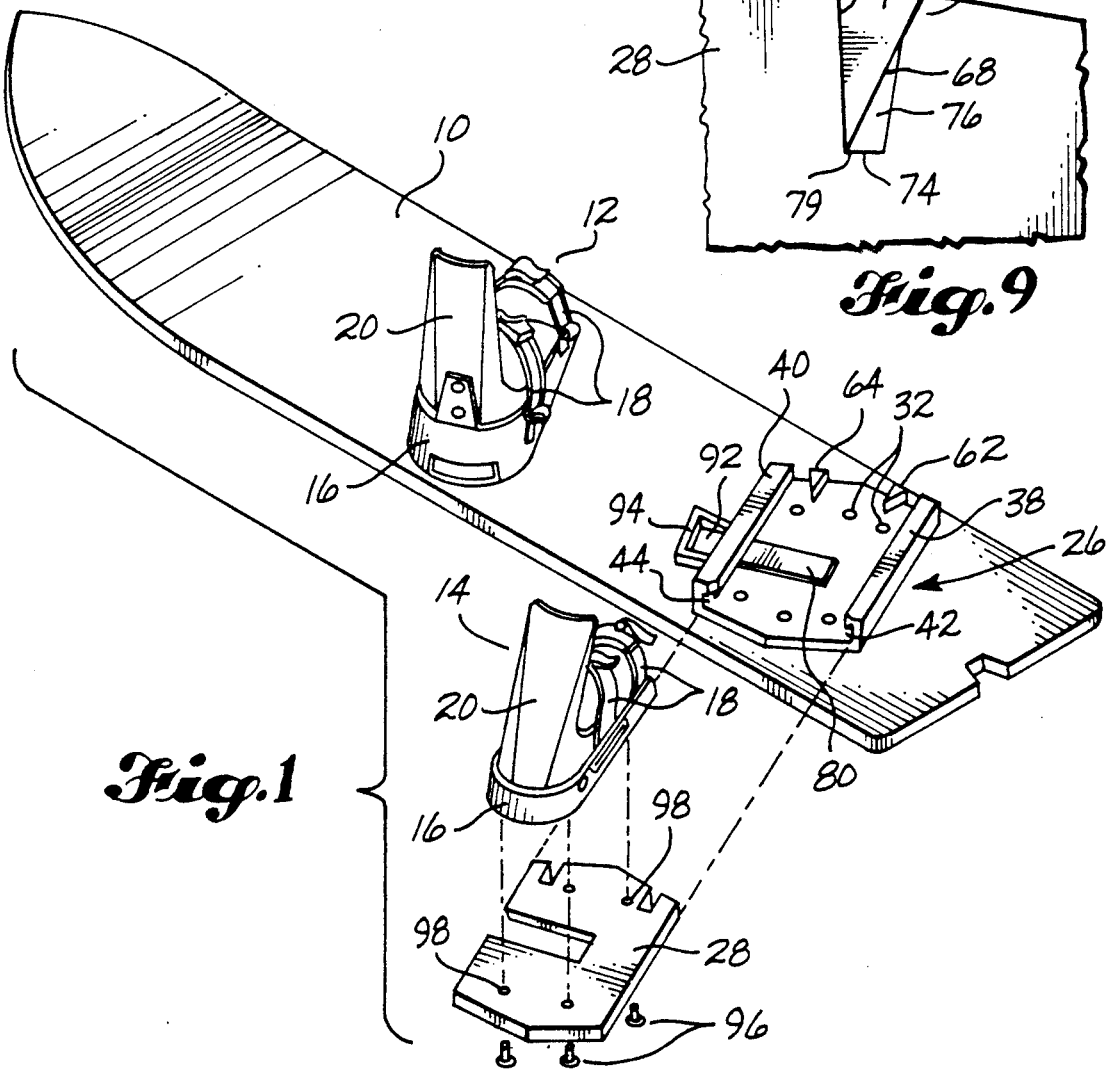
Fig. 1

34
38
52
56
42
62
30
10
26
80
84
64
44
58
54
40
36
92
94
10
40
94
92
36
44
64
68
66
66
68
32
62
6
4
54
80
30
32
42
26
34
38
52
6
4
63
72
48
86
5
70
98
61
98
50
46
28
5

10
24
26
28
30
34
38
42
52
56
60
62
80
82
84
86
88
90

RELEASABLE SNOWBOARD BINDING

TECHNICAL FIELD

This invention relates to a convenience-type releasable binding for use with snowboards.

BACKGROUND ART

In recent years, snowboarding has become a popular winter sport in the United States and other countries. It is usually done on commercially-operated slopes which were designed to accommodate skiers. Snowboarding differs significantly from skiing in that, rather than having separate skis for each foot and poles for each hand, both feet of the snowboarder are held, one in front of the other, on a single, reltively wide board and no poles are used. Also, unlike skiing, snowboard foot bindings are attached transversely or at an angle to the length of the snowboard.

Typically, a snowboarder wears relatively soft boots which are strapped or clamped onto the snowboard, rather than hardshell boots and safety-release bindings that are commonly used with snow skis. Use of safety-release bindings with snowboards are usually unnecessary. When a skier falls, each foot has a separate elongated lever attached to it which is capable of applying tremendous torsional force to the skier's ankles or knees. On the other hand, when a snowboarder has both feet attached to a single lever, twisting force from a fall is exerted on the torso, a portion of the human body much more capable of withstanding such forces without serious injury.

Because snowboarders do not use poles, one is virtually non-ambulatory when on relatively level ground and while attempting to maneuver onto chair lifts designed to accommodate skiers. Previously, a snowboarder faced with this problem would be forced to unbuckle or unstrap one foot from the board and to "skateboard" along, pushing with the free foot, or to free both feet and carry the board. Unbuckling or unstraping one's feet can be a cumbersome task. Furthermore, while it is desirable to have one foot freed while boarding the chair lift, it is also desirable to have both feet securely in place on the board when dismounting the chair lift at the top of the slope. This would mean that the snowboarder was forced to rebuckle or restrap the free foot to the board while hanging in midair on the chair lift, a task which can be cumbersome even under ideal circumstances.

While the popularity of snowboarding has increased sharply over the past few years, this inconvenience associated with snowboarding on slopes designed for skiers has been sufficient to deter some from attempting the sport and to add unnecessary exertion to those who do participate. Releasable bindings for snowboards have been presented in U.S. Pat. No. 4,652,007, issued to David Dennis on Mar. 24, 1987; and U.S. Pat. No. 4,728,116, issued to Kurt J. Hill on Mar. 1, 1988. The Dennis patent shows a system for adapting hardshell ski boots and releasable ski bindings for use with a snowboard. The system disclosed by Dennis is a safety-release system which causes both feet to be freed from the snowboard when either one becomes disengaged. This feature is necessary to provide complete safety to the snowboarder if either foot is allowed to be released during a fall. As previously discussed in reference to snow skiing, if either foot separately has an elongated lever attached to it during a fall, dangerous torsional strain can be exerted on the ankle or knee. This feature shown in Dennis does not, however, allow one foot to be independently released for the convenience of the snowboarder for "skateboarding" on relatively flat areas or moving through lift lines. Likewise, it would be extremely difficult for a snowboarder to insert both feet into such a safety binding system while on the chair lift between the bottom and top of the slope.

The Hill patent shows a pivotable releasable binding for use with snowboards. This binding system releases each foot separately which, although allowing the user to free one foot at a time for convenience, has the inherent safety deficiency described above. Additionally, the system disclosed by Hill presents a relatively complex and, therefore, expensive and bulky system.

SUMMARY OF THE INVENTION

The present invention provides a convenience-type releasable binding for use in combination with a snowboard. The binding includes a socket component which is mounted on the snowboard and has first and second spaced-apart upwardly-extending elongated side rails. Each side rail has an elongated flange portion extending laterally therefrom. A foot-engaging component is longitudinally engageable with the socket component. The foot-engaging component has a bottom and includes opposite side ribs positioned on the bottom to be slidably positionable below the flange portions of the socket component. A latch means releasably secures the foot-engaging component against movement in one longitudinal direction relative to the socket component and a stop means limits movement of the foot-engaging component in the opposite longitudinal direction.

The foot-engaging component may be attachable to a typical shoe binding or may be integrally formed with a shoe-binding apparatus.

A preferred embodiment includes a socket component in the form of an upwardly-turned channel having one open end into which the foot-engaging component may longitudinally slide. An opposite end of the channel is effectively closed by a stop member which prohibits the further movement or removal of the foot-engaging component from that end. A latch means secures the foot-engaging component when it is engaged with the socket against longitudinal removal therefrom. The latch means is releasable to allow the foot-engaging component to be removed from the socket at the user's convenience.

The present invention is not designed to provide a safety release binding which automatically releases during a fall. Instead, the present invention provides a convenience-type releasable binding which allows a snowboarder to separately release one foot without the need to unfasten or unbuckle a typical shoe-binding attachment and without the release of the other foot. The present invention provides this with a device which is lightweight, simple and reliable in operation, and inexpensive to manufacture.

BRIEF DESCRIPTION OF THE DRAWINGS

Like reference numerals are used to denote like parts throughout the various figures of the drawing, wherein:

FIG. 1 is a pictorial exploded view of a snowboard with the preferred embodiment of the present invention shown therewith;

FIG. 2 is a top view of a snowboard utilizing the present invention and showing the position of the freed rear foot relative to the snowboard for "skateboarding" movement;

FIG. 9 is a fragmentary top detail view of a stop member of the socket component engaged in a slot of the plate component.

BEST MODE FOR CARRYING OUT THE INVENTION

Figures 3, 4:
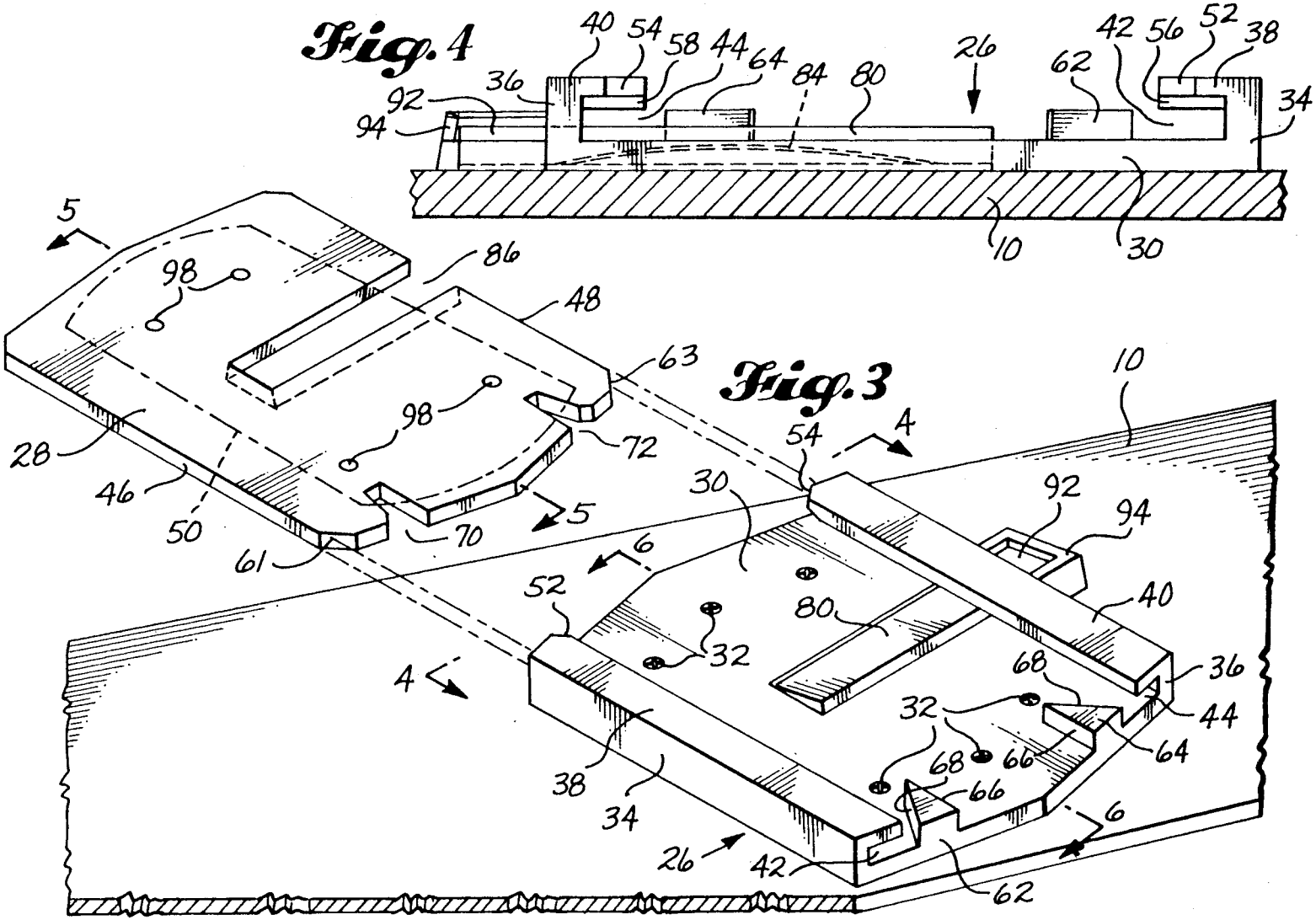
FIG. 3 is a fragmentary pictorial view of the socket portion of the binding attached to the snowboard and with the plate portion spaced therefrom in position for engagement.
FIG. 4 is a cross-sectional end view of the socket component taken substantially along line 4—4 of FIG. 3.

Referring to the various figures of the drawing, and first to FIG. 1, therein is shown a typical snowboard 10 having forward and rear foot bindings 12, 14. Each foot binding is comprised primarily of a base portion 16 a plurality of releasable clamp buckles or straps 18 which bridge from side to side of the base portion over the instep of the user's foot, and a calf support portion 20 extends upwardly from the base portion from the heel of the binding 12, 14. The base portion 16 typically includes upwardly extending side and rear edges against which the user's foot in a soft shoe or boot is positioned. The bottom of the base portion 16 typically includes an array of mounting holes which are adjustably positionable to align with at least a plurality of an array of mounting anchors formed into the upper surface of the snowboard 10. This type of foot binding and its mounting are per se well known in the art.

The embodiment illustrated in FIGS. 1 and 2 show a "left foot forward" arrangement of shoe bindings 12, 14. Depending upon the user's preference, this arrangement may be reversed and the exact angle to which the shoe binding 12, 14 is attached to the snowboard 10 may also be adjusted according to the user's preference. Typically, the forward foot is situated at an angle relative to the longitudinal direction of the snowboard 10 with the toe positioned somewhat forward of the heel. A typical position 22 of the forward binding is illustrated in FIG. 2. The rear foot is typically positioned substantially transverse to the longitudinal extension of the snowboard 10, or with the toe slightly forwardly inclined. The preferred embodiment of the present invention comprises a convenience-release attachment binding 24 including a socket portion 26 which is mounted to the top surface of the snowboard 10 and an attachment plate 28 which is longitudinally slidably engageable into the socket 26 and mountable to the base 16 of a typical show binding 14.

The socket component 26 includes a base portion 30 mountable to the top surface of the snowboard 10 by a plurality of counter-sunk mounting screws 32. Side portions 34, 36 extend upwardly from opposite side edges of the base plate 30. Laterally inwardly extending from each side portion 34, 36 is a flange portion 38, 40. Defined below each flange portion 38, 40 is a guide slot 42, 44 which is sized to longitudinally receive opposite side edges 46, 48 of the plate 28. The flanges 38, 40 are laterally spaced apart from one another sufficiently to permit the base 16 of a shoe binding 14 to be positioned 50 on the plate 28 so as not to interfere with the longitudinal insertion of the plate 28 into the socket 26. In order to facilitate insertion of the plate 28 into the socket 26, the entry end of the flange portions 38, 40 may include chamfered edges 52, 54, 56, 58. Likewise, the leading end of the plate 28 may also include a similarly chamfered edge 60 and corners 61, 63.

Sliding movement of the plate 28 is prevented beyond a fully engaged position by stop members 62, 64 which upwardly project from the top surface of the base portion 30 of the socket 26. The stop members 62, 64 are positioned to act as abutments against which the entering end of the plate 28 will be blocked. In preferred form, the stop members 62, 64 are in a generally triangular shape. The medial side 66 of each stop member 62, 64 is longitudinally straight, while the outer side 68 slopes outwardly therefrom in the longitudinal direction from which the plate member 28 is introduced into the socket 26. In the illustrated embodiment, this is from the rear and toward the front. The plate member 28 includes corresponding notches 70, 72 which engage the stop members 62, 64 when the plate 28 is fully engaged within the socket 26. The generally triangular shape of the stop members 62, 64 and the notches 70, 72 facilitate a firm connection between the components 26, 28 and the close engagement of the medial sides 66 of the stop members 62, 64 against the plate 28 increases the connection's resistance to any lateral or rotational movement of the plate 28 within the socket 26.

Referring particularly to FIG. 9, in a preferred form, the notches 70, 72 in the plate 28 may be formed with a widened throat portion 74 to form a gap 76 on the outer, angled side of each stop member 62, 64. This gap 76 allows room for snow and ice particles which may have been pushed into the notches 70, 72 as the plate 28 was slid into the socket 26 to be displaced as each stop member 62, 64 enters its respective notch 70, 72. At the leading edge of the plate member 28, the notch 70, 72 includes a portion 78 which is shaped to snugly engage the outer side 68 of the stop member 62, 64. This shape provides a snug and firm connection between the notch 70, 72 and its respective stop member 62, 64 without placing the entirety of the longitudinal force on the tip 79 of the stop member 62, 64 and while allowing a gap 76 for displacement of any accumulated snow or ice particles.

Figures 5, 6, 7, 8:
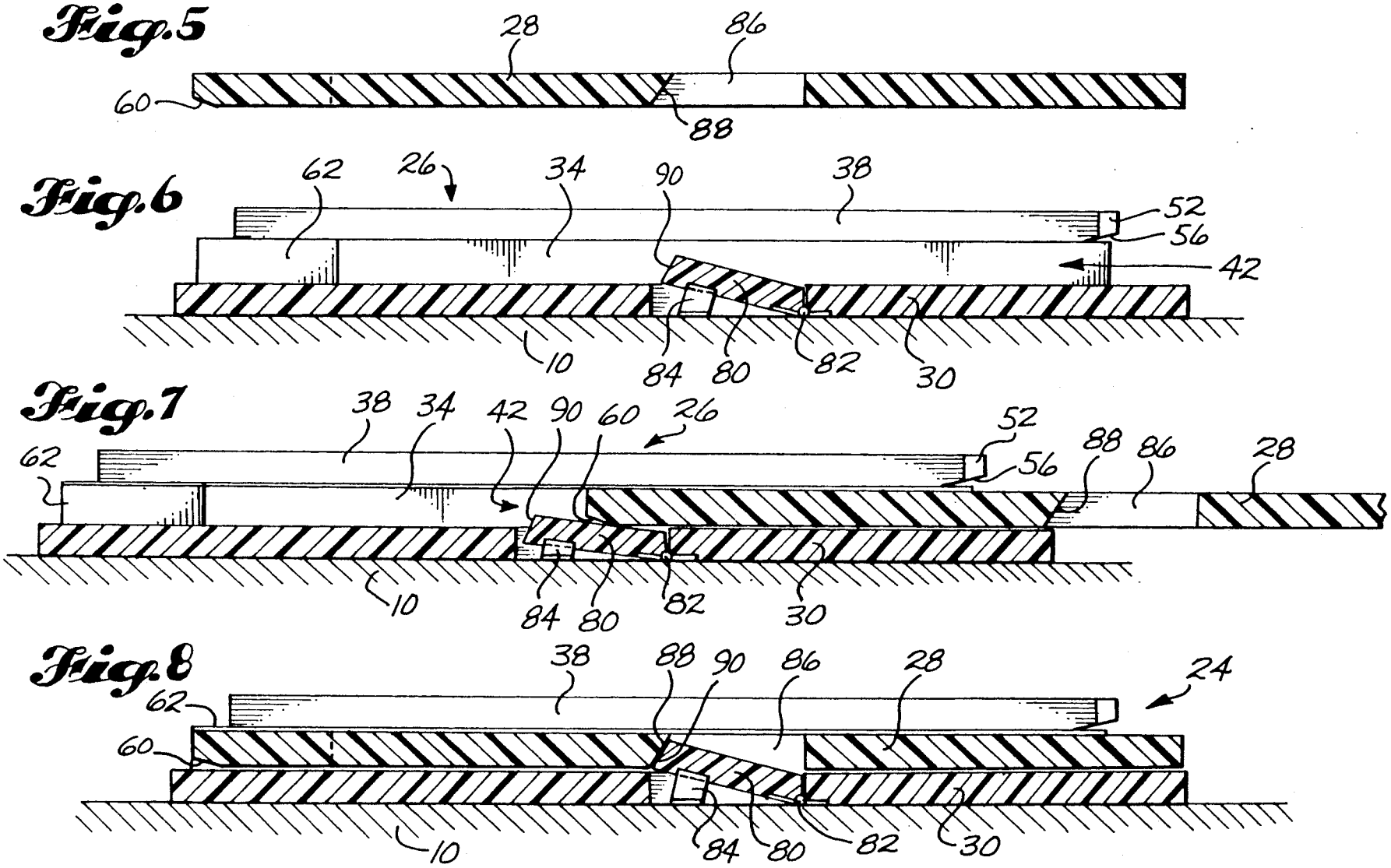
FIG. 5 is a longitudinal cross-sectional view of the plate component taken substantially along line 5—5 of FIG. 3.
FIG. 6 is a longitudinal cross-sectional view of the socket component taken substantially along line 6—6 of FIG. 3.
FIG. 7 is a longitudinal cross-sectional view of the plate component being partially inserted into the socket component showing the action of the latch member.
FIG. 8 is a longitudinal cross-sectional view of the plate and socket components of the binding in the engaged position.

Referring now also to FIGS. 7 and 8, a latch means is utilized to prevent longitudinal withdrawal of the plate 28 from the socket 26. In preferred form, the latch means includes a transversely-extending pawl 80 formed into the base 30 of the socket component 26 and extending upwardly and away from the entry opening of the socket 26. The pawl member 80 is hinged 82 along a lower edge and is biased into its normal upward position by a spring means 84. The hinge 82 may be integral, in the form of a relatively thin and flexible portion of plastic material, or may be a separate member formed of noncorrosive material such as plastic, brass or stainless steel. The spring means 84 is preferably in the form of a bowed leaf spring, as shown in FIG. 4. The spring means 84 may be in any suitable form which provides a resiliently-compressible expanding force against the pawl 80 and which will operate under a variety of temperature and weather conditions, such as a resiliently compressible synthetic or metallic material.

Referring to FIG. 6, the pawl member 80 closely fits against the base member 30 of the socket 26 along transverse edges so as to effectively prevent snow and ice particles from entering the area below the pawl member 80. Referring to FIGS. 5, 7 and 8, the leading edge of the plate member 28 may be slightly tapered or chamfered 60 to allow smooth movement of the plate member 28 over the pawl member 80, downwardly displacing the pawl member 80 until the plate member 28 is in a fully engaged position. When the plate member 28 reaches its fully-engaged position, as shown in FIG. 8, the pawl member 80 is upwardly biased into a notch 86 formed in the plate member 28 to block the plate member 28 against longitudinal retraction from the socket 26.

The notch 86 is provided with an outwardly-sloped edge 88 so that any snow and ice particles which may enter the notch 86 during walking with the plate 28 directly against the snow, will not bridge or cling within the notch 86, but rather will tend to fall free with nothing more than a gentle tap. The engaging surface 90 of the pawl member 80 is similarly angled or beveled to snugly engage with the angled surface 88 of the notch 86. This shape, as illustrated, also facilitates easy downward displacement of the pawl member 80 for pivotal movement about the hinge 82.

Referring now to FIGS. 3 and 4, the pawl member 80 includes an outwardly-extending tab portion 92 which facilitates manipulation of the pawl member 80. The tab portion 92 may extend laterally from either or both sides of the socket 26 a sufficient distance which will allow the user access to depress the tab 92 with a finger or thumb. access by the user's hand. To prevent an accumulation of snow or ice particles beneath the tab portion 92 of the pawl member 80 which might hinder displacement or release of the member 80, a protective guard 94 may be provided. The protective guard 94 comprises upwardly-extending wall sections which closely fit against side and end edges of the tab 92 such that no significant volume of snow or ice particles may enter therebetween. The guard 94 may stand upwardly slightly higher than the tab portion 92 itself so as to reduce the chance of accidental displacement of the tab 92.

As shown in FIGS. 1, 2 and 3, the longitudinal ends of the socket 26 and plate member 28 may have rounded or angled corners. This allows the components 26, 28 to be used and mounted in an angled position relative to the longitudinal direction of the snowboard 10, without corner portions overhanging side edges of the snowboard 10.

In preferred form, the socket component 26, including the pawl member 80, and the plate member 28 are made of synthetic thermoplastic resin such as nylon, Teflon, Delrin, polyethylene, etc., or other suitable material having high strength and a low co-efficient of friction. Such materials are lightweight and resist adhesion to snow and ice particles even when the material is at relatively low temperatures. The present invention may be molded, as with an injection process, from such materials in no more than two or three integral, unitary parts.

Depending upon the preference of the user, the socket 26 and plate 28 may be mounted as shown in FIGS. 1 and 2 for a "toe first" entry. Some users may prefer a "heel first" entry and the socket 26 and plate 28 mounting may be so reversed.

In the illustrated embodiment, the foot-engaging portion of the invention is in the form of a flat plate member 28 which is attachable by bolts 96 inserted through openings 98 in the plate 28 and into the base portion 16 of the shoe binding 14. The plate 28 is sufficiently wide such that the foot print 50 of the shoe binding 14, whether mounted for toe first entry or heel first entry, will not interfere with entry of the plate 28 into the channel of the socket 26. Alternatively, a shoe binding 14 may be made with an appropriately-shaped base portion 16 which would include the functional aspects of the plate member 28. Essentially, these aspects would be laterally protruding side edges 46, 48 to engage the slots 42, 44 of the socket 26 and an appropriately-positioned notch 86 for engagement with the latch pawl 80. Notches 70, 72 which engage the abutment or stop members 62, 64 could also be included in the base portion 16 of the shoe binding 14.

If the user desires a convenience release binding for each foot, a separate structure for the other foot may be utilized between the shoe binding 12 and the snowboard 10. Typically, however, it is only necessary or desirable that the rear foot be releasable. The illustrated embodiment provides an apparatus which adds a relatively insignificant thickness or spacing between the shoe binding 14 and the snowboard 10. However, if desired, a shim (not shown) could be used to equally space the other shoe binding 12 from the snowboard 10.

Referring to FIG. 2, in use, the snowboarder is likely to release the foot-engaging component (illustrated as plate member 28 attached to shoe binding 14) leaving the forward foot in its binding 12 in the forward-mounted position 22 while positioning the freed foot (100) beside the snowboard 10 to push or "skateboard" along on relatively level ground or while maneuvering through a lift line.

The illustrated embodiment is only one example of the convenience-release snowboard binding of the present invention and, therefore, is nonlimitative. It is to be understood that many changes the in the particular structure, materials and features may be made without departing from the spirit and scope of the invention. Therefore, it is my intention that my patent rights not be limited by the particular embodiment illustrated and described herein, but rather by the following claim or claims, interpreted according to accepted doctrines of claim interpretation, including the doctrine of equivalents.

What is claimed is:

1. A releasable foot binding apparatus for use in combination with a snowboard, comprising:

a socket component mounted on said snowboard, including first and second spaced-apart upwardly-extending elongated siderails, each said siderail having an elongated flange portion extending laterally therefrom;

a foot-engaging component longitudinally engageable with said socket component, said foot-engaging component having a bottom and including opposite side ribs positioned on said bottom to be slidably positionable below said flange portions of said socket component;

a latch means for releasably securing said foot-engaging component against movement in one longitudinal direction relative to said socket component; and a stop means for limiting movement of said foot-engaging component relative to said socket component in an opposite longitudinal direction, wherein said latch means includes a displaceable pawl member on said socket component, said pawl member being spring biased into a position to engage a notch formed in said foot-engaging component when said component is engaged with said socket component, and wherein said pawl member includes a portion extending outwardly of said socket component to a position accessible when said foot-engaging component is engaged in said socket component, such that said outwardly extending portion may be moved to in turn displace said pawl member and release said foot-engaging component for longitudinal removal from said socket component.

2. The apparatus of claim 1, wherein said socket component is in the form of an upwardly directed longitudinal channel having a base portion with said side rails upwardly extending therefrom and said flange portions inwardly extending from said side rails such that a space is defined between each said flange and said base portion, each said space being sized to longitudinally slidably receive one of said opposite side ribs of said foot-engaging component.

3. The apparatus of claim 2, wherein said channel and said pawl member are formed from a unitary piece of thermoplastic material.

4. The apparatus of claim 2, wherein said channel is formed from a unitary piece of thermoplastic material.

5. The apparatus of claim 1, wherein said notch includes a surface which confronts said pawl member, said surface being sufficiently outwardly beveled to prevent clinging of accumulated snow within said notch.

6. The apparatus of claim 1, wherein said stop means includes an abutment member positioned on said socket component and said foot-engaging component includes a notch shaped to receive said abutment member when said foot-engaging component is engaged in said socket component.

7. The apparatus of claim 6, wherein said abutment member is shaped to include a first edge which is parallel to the longitudinal direction of said engagement between said socket component and said foot-engaging component, and an adjacent second edge diverging therefrom such that said abutment member increases in width from a leading end longitudinally to an opposite end.

8. The apparatus of claim 7, wherein said notch in said foot-engaging component is shaped to have an edge closely fitting said first edge of said abutment member.

9. The apparatus of claim 1, wherein said stop means includes an abutment member positioned on said foot-engaging component, and said socket component includes a notch shaped to receive said abutment member when said foot-engaging component is engaged in said socket component.

10. The apparatus of claim 9, wherein said abutment member is shaped to include an edge which is parallel to the longitudinal direction of said engagement between said socket component and said foot-engaging component, and a second adjacent edge diverging therefrom such that said abutment member increases in width from a leading end longitudinally to an opposite end.

11. The apparatus of claim 10, wherein said notch in said socket component is shaped to have an edge shaped to fit closely with said first edge of said abutment member.

12. The apparatus of claim 2, wherein said bottom of said foot-engaging component includes a plate member with said side ribs positioned along opposite side edges thereof, said plate member being attached to a separate shoe-binding means.

13. The apparatus of claim 1, wherein said foot-engaging component includes a shoe-binding means with said bottom and said opposite side ribs integrally formed therewith.

* * * * *